United States Patent [19]

Verschuur et al.

[11] 3,992,784

[45] Nov. 23, 1976

[54] THERMAL DEWATERING OF BROWN COAL

[75] Inventors: Eke Verschuur; Berend P. Ter Meulen; Teunis Van Herwijnen; Johannes Boom, all of Amsterdam, Netherlands

[73] Assignee: Shell Oil Company, Houston, Tex.

[22] Filed: June 11, 1975

[21] Appl. No.: 585,914

[30] Foreign Application Priority Data

June 19, 1974 United Kingdom ..... 27190/74

[52] U.S. Cl. ..... 34/12; 34/15

[51] Int. Cl.[2] ..... F26B 7/00

[58] Field of Search ..... 34/15, 12, 9

[56] References Cited

UNITED STATES PATENTS

| | | | |
|---|---|---|---|
| 1,783,757 | 12/1930 | von Staden et al. | 34/15 X |
| 1,960,917 | 5/1934 | Nagelvoort et al. | 34/9 |
| 3,896,557 | 7/1975 | Seitzer et al. | 34/12 |

*Primary Examiner*—John J. Camby

[57] ABSTRACT

The invention relates to a process for the upgrading of solid material containing bound water and free or chemically bound carbon, in particular brown coal, which process involves a heat treatment at a temperature of at least 150° C and at a pressure that is higher than the vapor pressure of water at that temperature.

15 Claims, 3 Drawing Figures

THERMAL DEWATERING OF BROWN COAL

BACKGROUND OF THE INVENTION

The composition of coal as mined varies considerably, in particular with respect to the amount of ash-forming constituents and water. Certain types of brown coal may contain up to 70 percent by weight of water, largely bound chemically. The content of ash-forming constituents may amount to 40 percent by weight. The term brown coal is used here to indicate a variety of coals outside the range of hard coals and includes sub-bituminous coal, lignite and unconsolidated brown coal. Other materials belonging to the class defined above are peat, wood, paper, vegetable material, sewage sludge, etc.

It is highly desirable to upgrade such materials in order to improve their performance in various applications, such as combustion, or gasification processes. Moreover, upgrading will result in a considerable reduction in transport costs.

It is known that at high temperature coal not only loses chemically bound water, but undergoes such a change that at least no complete reabsorption of water will occur, not even when the coal is kept in a water phase at high pressure. This is due to a change in the coal itself, a phenomenon known as coalification. Application of a pressure exceeding the vapor pressure of water prevents the evaporation of the freed water, thus reducing the costs of the dewatering process. In view of the desirability of utilizing as an energy source the huge quantities of coal still available, in particular the softer grades, it should be possible to upgrade the coal in large quantities in continuous operation.

Attempts have been made to dewater brown coal and similar material by subjecting it to a heat treatment at elevated pressure. The philosophy underlying these attempts was that a charge of brown coal to be heat-treated should contain as little water as possible to begin with, since obviously a minimum of water then needs to be separated from it during and after the heat treatment.

Accordingly, it has been proposed in the prior art to pressurize a load of brown coal that has a dry appearance and subsequently to heat this load, whereafter any adherent water and the water that has been driven out thermally is separated, e.g., mechanically, from the brown coal so dewatered. Separation of the water is carried out at the earliest stage possible in the process, i.e. before depressurizing the brown coal.

A process based on the above principles would be rather complicated since it involves pressurizing a stream of solid material, heating the stream of pressurized solid material, separating brown coal and water mechanically at high pressure, depressurizing both the stream of dewatered brown coal and the stream of water and cooling either the combined or the separated streams of dewatered brown coal and water.

SUMMARY OF THE INVENTION

The present invention proposes a process wherein the drawbacks of the above prior art scheme have been overcome.

According to the invention the process of upgrading solid material containing bound water and free or chemically bound carbon is carried out by heat-treating the material at least at 150° C and pressure higher than the vapor pressure of water at the heat-treating temperature and preparing a pumpable slurry of finely divided solid material in water and pressurizing this slurry at a temperature below 100° C prior to the said heat treatment.

DESCRIPTION OF PREFERRED EMBODIMENTS

According to the present invention, dewatering of the solid material is carried out in an excess of water, which has been found very advantageous. A great advantage of this mode of operation according to the invention is the fact that a pumpable slurry more easily can be pressurized, heated, cooled and depressurized in a continuous process than a solid charge. It is possible, for example, to cool and depressurize the slurry simultaneously, without steam formation, while recovering the invested heat from the heat-treated slurry by heat exchange, e.g. with fresh slurry to be heat-treated. Heat flows rather more easily through a pumpable slurry than through a solid charge.

In general, the question whether a slurry is pumpable, depends on the amount of solids contained therein, the type of particles present, the particle size distribution, the pressure and the temperature of the slurry, etc. Pumpability, however, is a fairly well-defined criterion and accordingly not further spelled out here.

A very suitable slurry, according to the invention, is the type used for pipeline transport. Pipeline slurries have to meet certain requirements, for example that they should come within a specified range of viscosities. By treating a pipeline slurry according to the invention, the chemically bound water is removed from the solids and consequently the slurry reaches a higher content of free water. A certain amount of the free water can be removed from the treated slurry without departing from the specified range of viscosities. Thus, with the resulting slurry, less water is transported through a pipeline by the same effort.

A preferred aqueous slurry of carbonaceous or organic solids, according to the invention, only contains particles smaller than 2 mm. With such slurries the pressurizing step is relatively easy and normally results in savings more than equal the cost of pulverization. Due to the small particle sizes the heat treatment soon becomes effective and in most instances can be carried out in a tubular reactor of acceptable size.

According to one embodiment of the process, at least 98 percent by weight of the particles in the slurry is smaller than 1.4 mm and at least 15 to 20 percent by weight is even smaller than 44 micrometers.

Aqueous slurries of solid particles, in order to be pumpable, must at least contain a certain percentage of free water, i.e. water that is not chemically bound or otherwise enclosed in the solid material. The amount of free water required depends on a number of factors, including particle size distribution.

According to a preferred embodiment of the process of the invention, the slurry contains at least 30 percent by weight free water, i.e. water that is not chemically bound to the solid material. At lower water contents difficulties may be expected when pressurizing the slurry at a temperature below 100° C. At too high a water content, on the other hand, the process tends to become uneconomic, since extra water has to be pressurized and heated.

Accordingly, the slurry preferably should not contain more than 50 percent by weight free water. However, in some instances, it might be useful to apply a larger excess of water during the heat treatment, which excess then could be separated at the elevated temperature and pressure required during the heat treatment, i.e. before depressurizing and cooling the slurry, whereafter the excess water could be recycled as a heat carrier to dilute a further amount of fresh slurry.

According to the invention, a slurry is prepared which contains the solid material in a finely divided form. This slurry may be prepared in-situ by grinding lumps of the solid material and by dispersing the ground material in water, or by grinding the solid material together with water. The slurry may also have been prepared elsewhere and supplied via a pipeline. In the case of brown coal, for example, the solid material may have been mined by means of water, in which case a slurry will be available after wet grinding. Preparation of a slurry will not meet, as a rule, with severe difficulties, and a large number of technically proven processes are readily available for this purpose.

The next step, according to the invention, is the pressurizing step at a temperature below 100° C. For large quantities of slurry and in continuous operation, this is no problem. Pressurizing can easily be effected by pumps, colloid mills, etc. Although, in general, pressurizing could be carried out at ambient temperature, it might be attractive to carry it out at a higher temperature since the viscosity of the slurry will then be lower, so that less energy is then needed for pressurizing.

As specified above, the heat treatment has to be carried out at a higher pressure than the vapor pressure of water at the prevailing temperature. In this way the heat treatment need not furnish the energy required for vaporization of the water. The pertinent physical data are known, of course, and need not be provided here. However, it should be mentioned that the heat treatment is preferably carried out at a pressure only slightly above the vapor pressure of water at that temperature. Thus, the amount of power required to pressurize the slurry is minimized.

According to a preferred embodiment of the invention, the heat treatment is carried out above 200° C. Good results are obtained at temperatures of 250° C or higher. At 250° C heat treatment requires a pressure in excess of 42 bar.

It has been found that the amount of bound water still present in the solid material after the heat treatment depends to a great extent on the temperature applied during the heat treatment, i.e. the higher the temperature, the more water will be withdrawn.

The heat-treated slurry of finely divided solid material in water becomes available at high temperature and high pressure. In some instances, especially when the heat treatment according to the invention is carried out at or near the site where the solid material is ultimately used, it may be advantageous to supply the solid material in the form of an aqueous slurry. It is also possible, if the site of ultimate use is at a certain distance from the place where the heat treatment took place, to transport the solid material to that site, e.g. by pipeline in the form of an aqueous slurry.

Such an aqueous slurry of solid material may in some cases be supplied for ultimate use at an elevated pressure and/or temperature. This will depend, however, entirely on the application concerned.

Alternatively, the free water may be partly or wholly removed from the treated aqueous slurry of solid material. The slurry may be partly or wholly cooled and/or depressurized, depending on its ultimate application. The resulting product may still be a pumpable slurry, which has been enriched, however, in percentage of solids and which may be transported by pipeline to a consumer area.

Separation of at least part of the free water from the treated slurry may be carried out before, during, and/or after cooling and/or depressurizing of the treated slurry. When the separation is carried out completely and at elevated pressure, in pressure-tight equipment, a powdered and dewatered solid material is obtained under pressure, e.g. in a hopper, which is very attractive when the upgraded material is to be applied in a process under pressure. One example of the latter type of process is the gasification of dewatered brown coal at high pressure by partial combustion.

An unexpectedly high degree of removal of bound water is attained when the slurry is brought into turbulent motion, in the presence of a binder that is insoluble in water, during and/or after the heat treatment, which results in a dispersion of agglomerates of solid material in water. Carbonaceous material may thus be upgraded through separation of ash-forming constituents, which remain dispersed in the water as fine particles. Since in the case of carbonaceous solids the agglomerates have larger dimensions, the fine ash-forming constituents easily may be removed together with the water by adequate sieving or the like. This combination of dewatering and deashing in the case of carbonaceous solids is possible only because of the fluidity of the dispersion introduced in the process according to the invention.

Preferably, in the case of brown coal, the binder consists of a light hydrocarbon, such as propane, butane, pentane or naphtha. From the dispersion of agglomerates of brown coal in water the water is separated, followed by removal of the binder from the brown coal agglomerates by evaporation, which binder may be recirculated after condensation. Evaporation may be carried out in a fluidized bed. The fluidizing gas may be any inert gas. Preferably binder material in the vapor state is used as the inert gas. The brown coal agglomerates may be ground prior to the evaporation of the binder. This procedure results in highly upgraded brown coal prepared in continuous operation. The material may be obtained in particles of millimeter dimensions, suitable for dust-free storage. If grinding is applied, a pulverulent brown coal is obtained that can be fed immediately to a burner in a furnace or a gasifier. Owing to the removal of water and ash, the quality of the upgraded brown coal is such that combustion or gasification proceeds without any problems.

Separation of binder and/or water may be carried out under pressure. Preferably this pressure is at least equal to the pressure in the system in which the upgraded material is to be used or handled. It is advisable that during all operations the pressure be kept at least equal to the pressure in the system in which the upgraded material is to be used or handled. The advantage so obtained is that pressurizing the pumpable slurry of the solid material in water at the beginning of the process is sufficient to carry out the dewatering and the eventual deashing and to bring the treated material into the system in which it is ultimately used. Any pressurizing of intermediate streams is then avoided.

In some cases fuel oils or other heavy hydrocarbons are preferred as a non-recoverable binder. One example of such a case is that where the ultimate agglomerates of treated brown coal and binder are required or usable as such. Another is that where the agglomerates are mixed with a further quantity of fuel oil for the production of usable slurries of brown coal in fuel oil.

Evidence has also been obtained that in some cases the solid material can be dewatered further if at least part of the binder is added before or during the heat treatment, possibly even before pressurizing below 100° C takes place.

Thus, according to a preferred embodiment of the invention the binder is added in portions before, during and/or after the heat treatment. A solid binder that becomes liquid upon heating the slurry after addition of the binder is a possibility. Addition of the binder before heat treatment may be advantageous in that foaming will not be likely.

The process according to the invention will now be further elucidated with the aid of three diagrams depicting flow schemes of three different embodiments.

Figure 1:
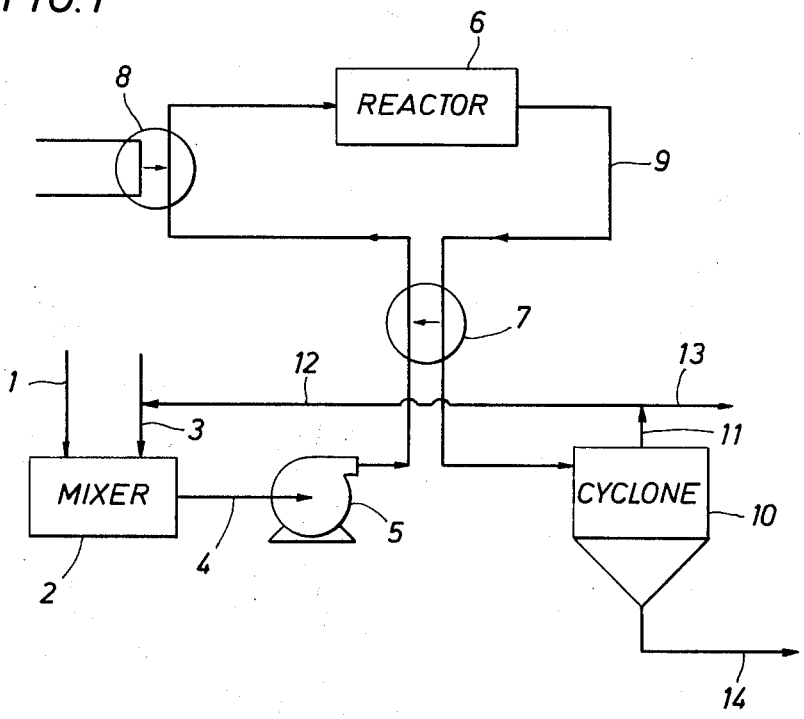
FIG. 1 illustrates one embodiment.

According to FIG. 1 a stream 1 of fine particles of carbon-containing material to be upgraded is fed to a mixer 2 together with a stream 3 of water. A slurry in water is made in such a concentration that a pumpable stream 4 is obtained. This stream 4 is passed to a pump 5 which pressurizes the slurry to a pressure sufficiently high to prevent boiling of water later on in a reactor 6 to which the slurry 4 is fed. Pressurizing with pump 5 takes place at a temperature below 100° C to prevent the boiling of water upstream of the pump 5. Heat exchangers 7 and 8 transfer heat to the slurry in order to bring it to the desired temperature of at least 150° C. Dewatering takes place in reactor 6. The dimensions of reactor 6 have been so chosen that the residence time of the heated slurry is sufficiently long to set free the chemically bound water and to permit coalification of the raw material. This residence time depends upon the type of carbon-containing material and on the desired degree of dewatering. In general, a residence time of a few minutes is sufficient. The treated slurry leaves the reactor 6 as a stream 9, which contains more free water than stream 4. After cooling down in heat exchanger 7, water may be removed in a cyclone 10, resulting in a stream of water 11, part of which is recirculated as stream 12 and another part of which is discharged as stream 13. The underflow 14 of cyclone 10 consists of upgraded carbon-containing material, together with water, if desired. The separation in cyclone 10 may be carried out at the process pressure or at a lower pressure, depending on the ultimate use of the material. This process is useful for treating materials having a low ash content.

Figure 2:
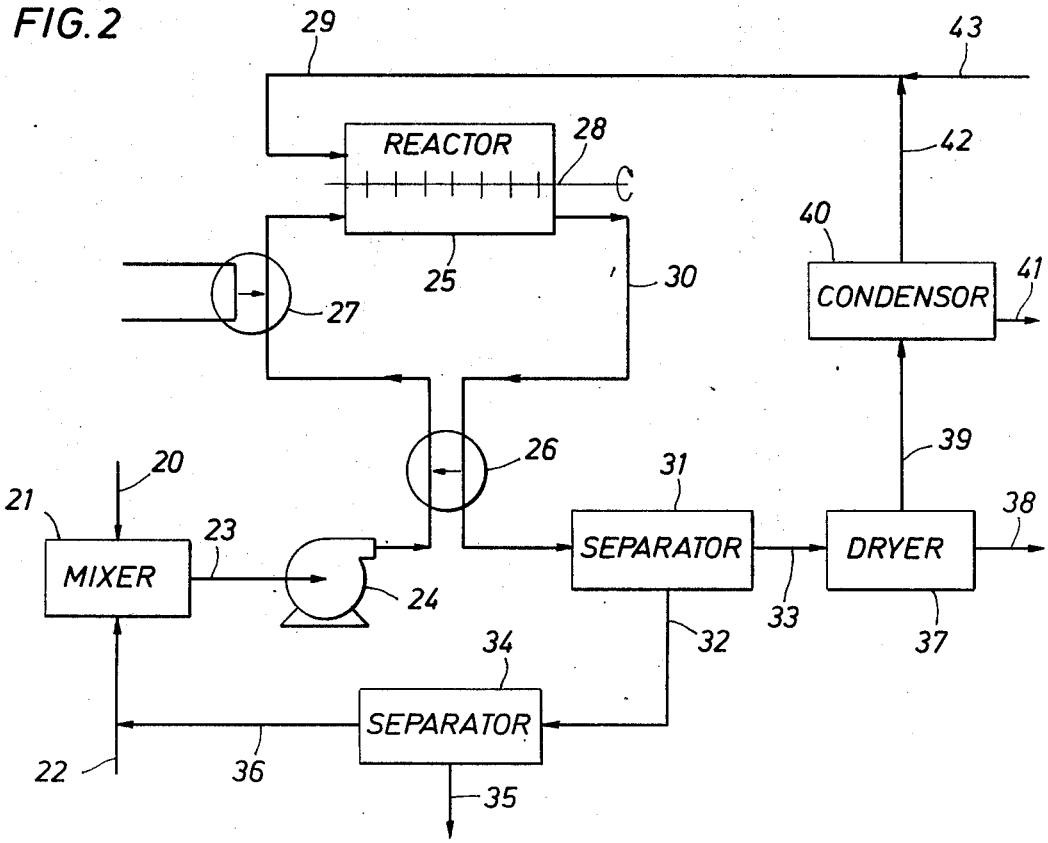
FIG. 2 illustrates another embodiment.

According to FIG. 2 a stream 20 of fine carbonaceous particles to be upgraded and a stream of water 22 are fed to a mixer 21. A slurry in water is made in such a concentration that a pumpable stream 23 is obtained. Pump 24 pressurizes this slurry to the desired pressure as outlined before. In this example reactor 25 has two functions. After passing heat exchangers 26 and 27, stream 23 has reached the desired temperature above 150° C for the heat treatment, which is the first function. The required residence time is spent in reactor 25. The second function is agglomeration of the carbonaceous particles and simultaneous separation from ash particles. To this end a rotatable member 28 is present in the reactor 25. This member may be a shaft with radially extending blades or a closed cylinder surface. Together with the dispersion 23, a stream 29 of binder is added, e.g. butane or naphtha. A dispersion 30 of agglomerates in water is withdrawn from reactor 25 and passed to a separator 31, from which a stream 32 of ash-containing water and a stream 33 of agglomerates is obtained. The ash-containing stream 32 is passed to a separator 34, producing solid ash 35 and clean water 36 which is recirculated.

The agglomerates 33 contain the binder and some adhering water. In a dryer 37 binder and water are evaporated, which results in dry agglomerates of deashed and dewatered carbonaceous material. The vapor stream 39 is passed to a condenser 40, from which a stream 41 of water and a stream 42 of binder are obtained. Together with some make-up stream 43 of binder, the stream 29 is obtained. The entire process may be carried out under pressure and the upgraded carbonaceous material 38 may be stored under pressure, which is of importance if it is used in a combustion or gasification process under pressure.

Figure 3:
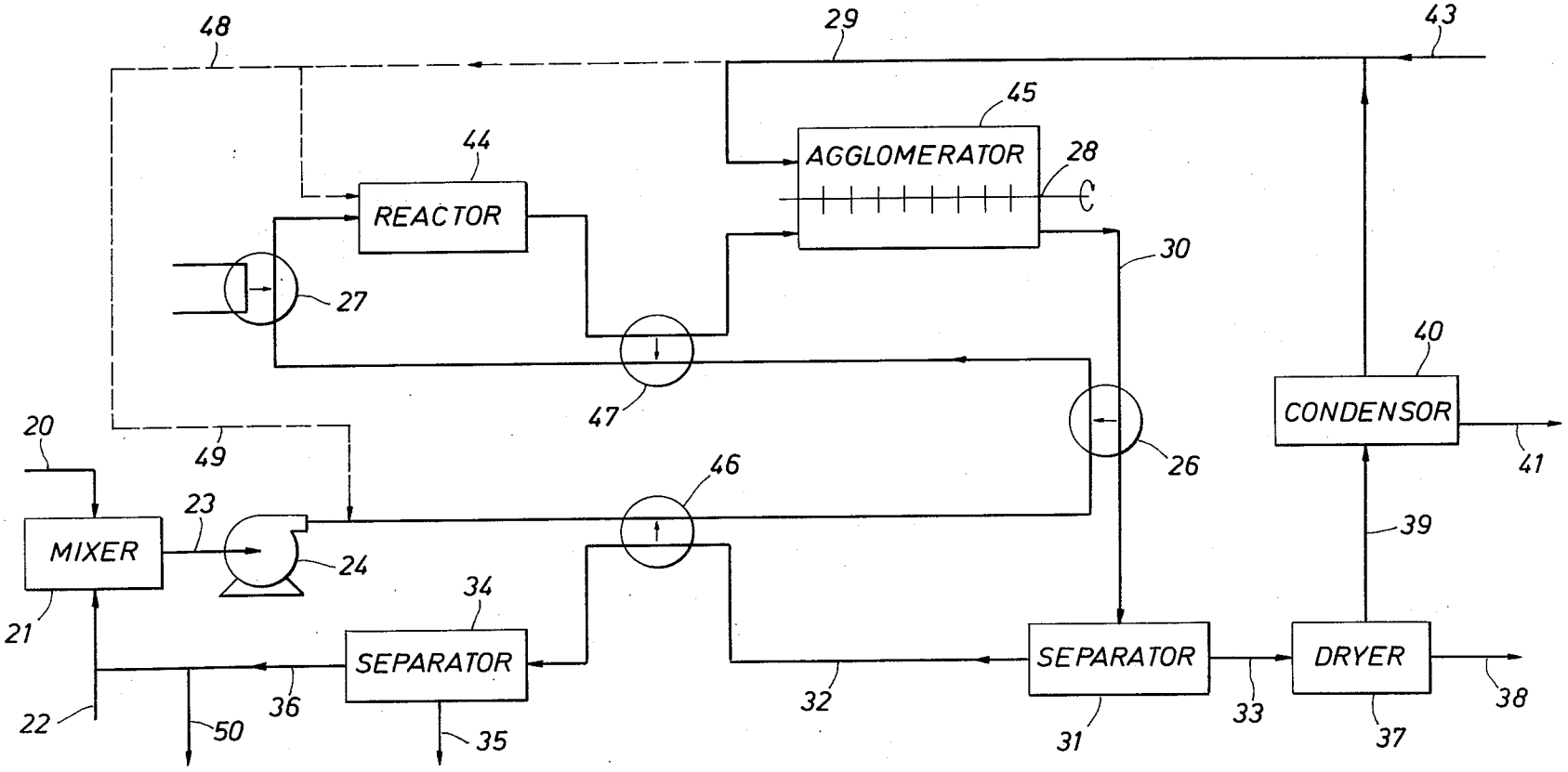
FIG. 3 illustrates still another embodiment.

Another embodiment of a process according to the invention is given in FIG. 3. Parts and streams corresponding with those in FIG. 2 are numbered correspondingly. In this embodiment the reactor 44 and the agglomerator 45 are not combined. This gives more latitude with regard to residence times and temperatures for the dewatering and the deashing process, which might be attractive in some cases. The deashing and agglomeration is preferably carried out under milder conditions than the dewatering. Additional heat-exchangers 46 and 47 are present. The dotted lines 48 and 49 show the possibility of feeding side streams of the binder 29 to the reactor 44 and/or the pressurized stream leaving the pump 24. Some conditioning of the surface of the carbonaceous particles for the final agglomeration process may thus be obtained. A drain 50 will in general be necessary to maintain the desired amount of water in the process.

EXAMPLE

The process of the present invention will be further illustrated by the following example, in which a few scouting experiments are described, showing that a brown coal, originally containing 66 percent by weight of water, can be dewatered without evaporation of the water to a product containing 8 percent by weight of water, by a thermal treatment at high temperature and pressure, followed by selective agglomeration with a binder in a pelletizer.

Experiments were performed in a 3-liter reaction vessel provided with a turbine stirrer. The vessel was filled with 1.5 liter of slurry containing 50 percent by weight of Freche Tagebau brown coal. The inherent moisture content of this German brown coal was 43.5 percent by weight and the calorific value on a dry basis was 5263 kcal/kg. The vessel was electrically heated to 300° C in 1.5 hours. Then in most cases binder was added in the form of n-$C_{12}$ hydrocarbons or 800'' fuel oil and the vessel was subsequently cooled to 50° C in 4.5 hours. The residual pressure was released, the vessel was opened and the contents were poured out on a standard Büchner filter paper to collect all solids and vacuum filtered until 1 minute after cake formation became visible.

The results of these scouting tests are summarized in the Table.

TABLE

| Exp. No. | %w binder on bone-dry coal n-$C_{12}$ | 800'' fuel | Binder moisture content |
|---|---|---|---|
| 1 | 0 | 0 | 56.0 |
| 2 | 15 | 0 | 54.5 |
| 3 | 30 | 0 | 35.8 |
| 4 | 40 | 0 | 35.8 |
| 5 | 42 | 0 | 31.4 |
| 6 | 45 | 0 | 31.4 |
| 7 | 0 | 30 | 28.3 |
| 8 | 0 | 35 | 15.5 |
| 9 | 0 | 40 | 8.0 |

A blank experiment was moreover carried out at 20° C, yielding a brown coal with a moisture content of 66.0 percent by weight.

The table indicates that a moderate reduction in moisture content results from thermal treatment only (test 1). Moreover, if an appropriate amount of binder is added, a considerable reduction in moisture content is reached.

In none of the experiments were firm pellets produced, although the agglomerates obtained could be substantially dewatered. It is assumed that the stirrer/vessel combination is not an optimum pelletizer, as was confirmed by bench-scale pelletizing tests with the materials resulting from experiment 7. After centrifuging the micro agglomerates from this experiment, a very compact mass was obtained which contained considerably less water.

Indications have been obtained that heat is produced by chemical decomposition during the dewatering of brown coal.

We claim as our invention:

1. A process for upgrading solid material containing bound water and free or chemically bound carbon by disbonding at least part of the bound water which comprises the steps of (A) preparing a pumpable slurry of the solid material in water, (B) pressurizing the slurry at a temperature below 100° C, (C) heat treating the slurry at a temperature of at least 150° C and at a pressure that is higher than the vapor pressure of water at that temperature, and (D) transferring at least part of the heat added in step (C) to the slurry prior to step (C).

2. The process of claim 1 wherein the temperature of the slurry of step (D) is reduced to below 100° C and the slurry is depressurized without steam formation.

3. The process of claim 2 wherein the water is separated from the depressurized slurry and the upgraded solid material is sent to combustion.

4. The process of claim 2 wherein the water is separated from the depressurized slurry and the upgraded solid material is sent to gasification.

5. The process of claim 1 wherein some water is removed from the slurry of step (D) and the remaining slurry is transported to another location.

6. The process of claim 5 wherein the slurry is pipeline transported.

7. The process of claim 5 wherein the removed water is utilized in preparing the slurry of step (A).

8. The process of claim 1 wherein more bound water is separated from the solid material by exposing the slurry to turbulent motion in the presence of a binder that is insoluble in water.

9. The process of claim 8 wherein binder is added before, during and/or after step (C).

10. The process of claim 8 wherein the binder is a non-recoverable heavy hydrocarbon or mixture of heavy hydrocarbons.

11. The process of claim 8 wherein the binder is a recoverable light hydrocarbon or mixture of light hydrocarbons.

12. The process of claim 1 wherein the solid material is further upgraded by adding a binder to the slurry to form a dispersion of agglomerates of solid material in water while ash-forming constituents of the solid material remain dispersed in the water as fine particles, and subsequently separating the water and fine particles from the agglomerates.

13. The process of claim 12 wherein binder is separated from the substantially water-free agglomerates by evaporation carried out in a fluidized bed, and then the separated binder is recirculated and added to slurry to form agglomerates.

14. The process of claim 13 wherein at least part of the heat added in the fluidized bed is transferred to the slurry prior to step (C).

15. The process of claim 12 wherein the agglomerates are formed after step (C) and at least part of the heat added in the formation of agglomerates is transferred to the slurry prior to step (C).

* * * * *

Notice of Adverse Decision in Interference

In Interference No. 100,140, involving Patent No. 3,992,784, E. Verschuur, B. P. Ter Meulen, T. Van Herwijnen and J. Boom, THERMAL DEWATERING OR BROWN COAL, final judgment adverse to the patentees was rendered Apr. 28, 1982, as to claims 1 and 2.

[*Official Gazette October 19, 1982.*]